United States Patent [19]

LaPointe

[11] 3,940,044

[45] Feb. 24, 1976

[54] FASTENER DRIVER WITH SAFETY DEVICE

[75] Inventor: Gabriel M. LaPointe, Worcester, Mass.

[73] Assignee: Parker Manufacturing Company, Worcester, Mass.

[22] Filed: Oct. 15, 1974

[21] Appl. No.: 514,850

[52] U.S. Cl. ..... 227/8; 227/125

[51] Int. Cl.[2] ..... B25C 5/06

[58] Field of Search ..... 227/5, 6, 7, 8, 123, 125, 227/126

[56] References Cited

UNITED STATES PATENTS

| | | | |
|---|---|---|---|
| 1,829,537 | 10/1931 | Polzer | 227/126 |
| 1,945,377 | 1/1934 | Posnack | 227/123 |
| 2,233,958 | 3/1941 | Obstfeld et al. | 227/126 |
| 3,809,307 | 5/1974 | Wandel et al. | 227/8 |

*Primary Examiner*—Granville Y. Custer, Jr.
*Attorney, Agent, or Firm*—Norman S. Blodgett; Gerry A. Blodgett

[57] ABSTRACT

Driver for fasteners, wherein a slidable element contacts a work surface to allow fasteners to be driven, but otherwise inhibits the driving of fasteners.

4 Claims, 5 Drawing Figures

FASTENER DRIVER WITH SAFETY DEVICE

BACKGROUND OF THE INVENTION

For many years mechanical devices have been used for driving fasteners in the construction trades. For instance, stapling guns have been used for driving staples and nail drivers have been used for driving nails. These devices project the fastener with considerable force and, in the absence of a work surface, the fasteners fly through the air considerable distances and with considerable force. Since all such fasteners are provided with sharp ends, the fastener driver becomes a very dangerous piece of equipment. In the construction trades, however, the workers are aware of these dangers and tend to be careful in handling such equipment, because it is their livelihood. Stapling guns and nail drivers are now being used, however, by homeowners in performing repairs around their homes and, therefore, the fastener driver becomes available to children. Because they are often shaped to resemble guns, they become an attractive nuisance so far as children are concerned. The danger to themselves and to other children increases as such devices become more readily accessible to children and as the children become more used to them. These and other difficulties experienced with the prior art devices have been obviated in a novel manner by the present invention.

It is, therefore, an outstanding object of the invention to provide a fastener driver which is not capable of projecting the fastener through the air.

Another object of this invention is the provision of a fastener driver which is only operative to drive fasteners when it is pressed against a work surface.

A further object of the present invention is the provision of a driver for fasteners wherein the fasteners are carried in a cartridge but are inhibited from entering the driving area unless the fastener-emitting exit is pressed against a work surface.

It is another object of the instant invention to provide a fastener driver in which the fasteners are arranged seriatim, so as to be advanced one by one to a driving position, and wherein the advance is inhibited unless the driver is in a safe condition.

With these and other objects in view, as will be apparent to those skilled in the art, the invention resides in the combination of parts set forth in the specification and covered by the claims appended hereto.

SUMMARY OF THE INVENTION

In general, the invention consists of a driver for fasteners having a housing with a handle and with a fastener exit. A track is mounted in the housing for supporting the fasteners to present them one by one to the said fastener exit and means is mounted in the housing for driving a fastener through the exit. A safety device mounted on the housing serves normally to inhibit the driving of a fastener and allows it only when the exit is pressed against a surface.

More specifically, the safety device includes a finger which extends away from the housing adjacent the said exit and is movable when the housing is moved toward and away from the said surface. The finger is biased by a spring into a normally-extended position where it inhibits the driving of a fastener but can be moved into a retracted position by contact with the surface in which position the driving of the fastener is permitted.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
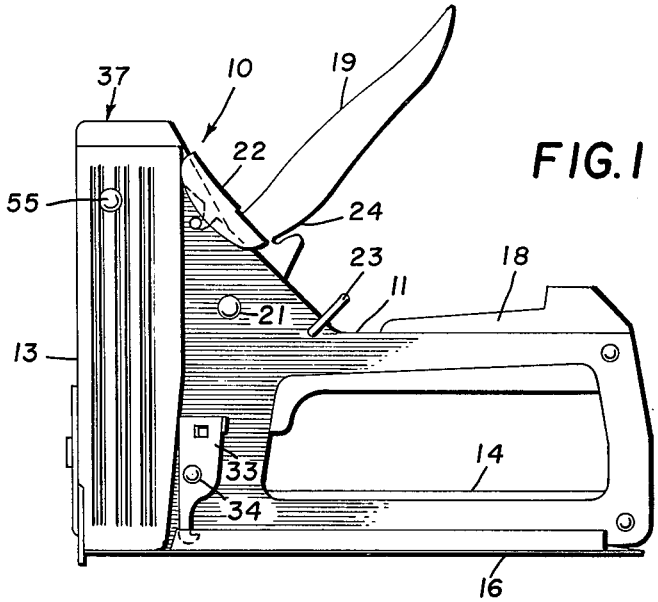
FIG. 1 is a side view of a driver for fasteners embodying the principles of the present invention.
Figure 2:
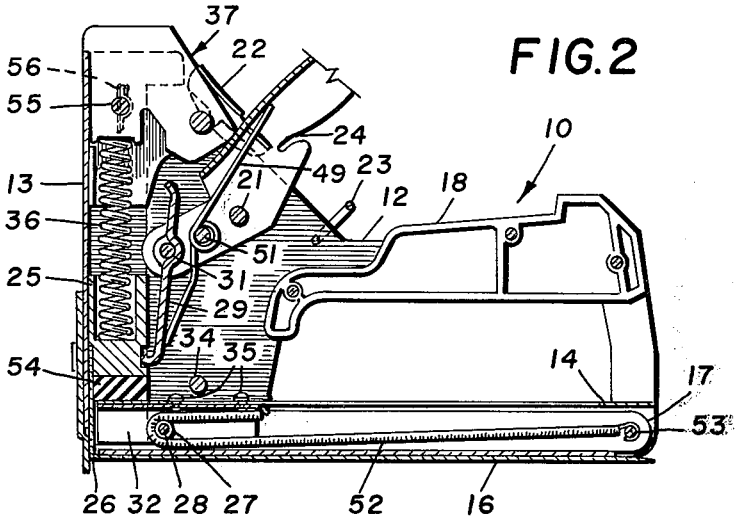
FIG. 2 is a vertical sectional view of the driver showing details of the construction.

Referring first to FIGS. 1 and 2, wherein are best shown the general features of the invention, the driver 10 is shown for the purpose of description as a stapling gun for driving fasteners in the form of staples. It is formed with two spaced parallel side frames 11 and 12 which are embraced along corresponding normally vertical straight edges by a U-shaped front frame 13. The side frames are held in spaced parallel relationship by a frame channel 14 running along corresponding bottom edges. Bumper retainers are also located between the side frames and a unit is provided with a base 16. The staple guide 17 is located within the frame channel 14. A plastic handle 18 is located between the side frames. An actuating handle 19 is pivoted between the side frames on a pivot pin 21 and a shield 22 is mounted on the handle. A lock loop 23 is pivoted on the side frames and is adapted to engage a slot 24 formed in the handle. A hammer 25 is located between the side frames within the front frame 13 and is provided with a staple driver blade 26 fastened thereto and resting against the bight of the U-shaped front frame 13. A spring guide roller 27 is mounted within the staple guide 17 and is rotatably mounted on a spring guide roller pin 28. A hammer lifter 29 is mounted on a pivot pin 31 as a lever between the side frames 11 and 12 and between downwardly-depending flanges formed on the handle 19. A latch 33 is mounted on the outside of each of the side frames by means of a pivot pin 34. A staple-pressure slide 32 is mounted in the staple guide 17. The slide 32 is fastened within the frame channel 14 by means of slide rivets 35. A hammer spring 36 rests in an upwardly directed recess formed in the top of the hammer 25.

Between the side frames 11 and 12 and within the front frame 13 is mounted a cap member 37 consisting of outside laminations within which are provided spring-confining laminations. There are also five litter cam laminations which are located between the spring-confining laminations. A latch spring is associated with the latch 33, while a lifter spring 49 is mounted on a pivot pin 51 in the handle 19. A staple feed spring 52 is mounted within the staple guide 17 and has one end attached to a hinge pin 53, while the other end is attached to the slide 32. A rubber bumper 54 is mounted above the frame channel 14 and underlies the hammer 25.

A rivet 55 extends through the side flanges of the front frame 13 and through corresponding apertures in all of the laminations. At one end the rivet is provided with an aperture through which extends a lock spring 56 of a well-known type.

Figure 3:
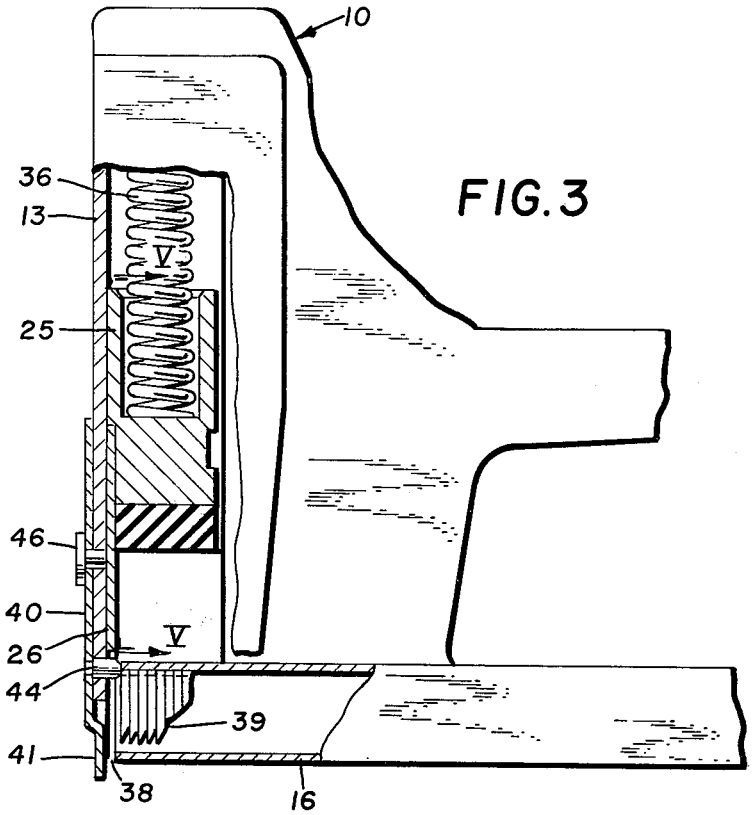
FIG. 3 is an enlarged vertical sectional view of the driver showing the details of the safety device.
Figure 4:
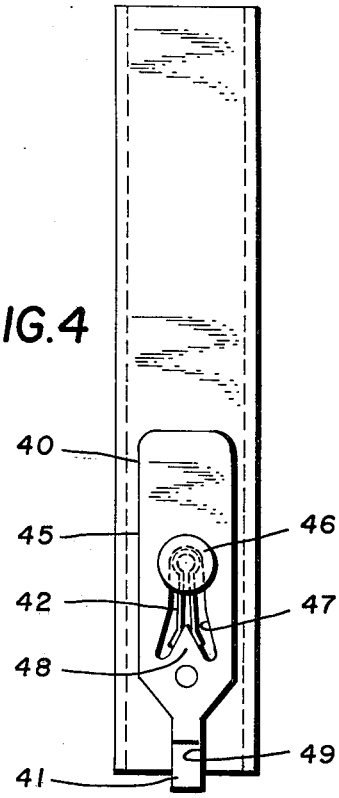
FIG. 4 is an end elevational view of the driver.
Figure 5:
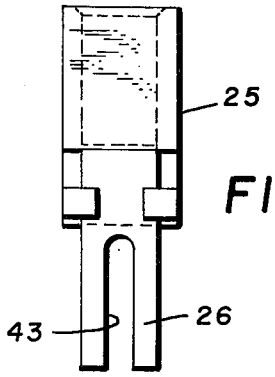
FIG. 5 is a sectional view of a portion of the apparatus taken on the line V—V of FIG. 3.

Referring next to FIGS. 3, 4, and 5, wherein are shown the details of the safety device, it can be seen that the fastener exit is indicated by the reference numeral 38 and that the staples 39 are mounted on a track in the housing which supports them to present them seriatim to the said fastener exit. The hammer 25 provides a means mounted in the housing for driving a fastener through the exit. A safety device 40 is mounted in the housing and normally inhibits the driving of a staple, but allows such driving to take place when the area around the exit 38 is pressed against a working surface. The safety device includes a finger 41 which extends away from the bottom wall of the base 16 adjacent the exit 38 and which slides in accordance with movement of the housing toward and away from the working surface.

The finger is biased by a spring 42 (see FIG. 4) into a normally-extending position where it inhibits the driving of a staple, but can be moved into a retracted position by contact with the working surface, in which position it allows the driving of the fastener. The hammer 25 is spring-loaded by the spring 36 and is provided with the staple driver blade 26 which is slidable toward and away from the exit 38. A lever system, including the lifter 29 and the handle 19, is provided to lift the hammer and then release it for the driving operation.

The driver blade 26 is provided with a median slot 43 and the safety device 40 has an abutment 44 that extends through the slot 43 for engagement in the inhibiting position with the leading end of the series of staples 39, the slot being of sufficient size that the abutment does not interfere with the movement of the hammer 25 and its driving blade 26. The end wall of the front frame 13 extends perpendicular to the flat bottom wall of the base 16 in which the exit 38 is located. The safety device 40 is formed in part as a flat plate 45 which is slidable on the surfaces of the end wall and which carries the finger 41 at its lower end adjacent the bottom wall 16. A rivet 46 is fixed in the end wall and extends through a slot 47 in the plate 45. The slot is of an upside-down or reversed Y-shape which defines an upwardly directed point 48. The spring 42 is generally U-shaped and is mounted on the rivet 46 with its legs straddling and engaging the sides of the point 48. The end wall of the front frame 13 is provided with a slot 49 adjacent the bottom wall, the finger 41 being bent away from the plane of the plate 45 so as to reside in and be guided by that slot.

The operation of the fastener driver will now be readily understood in view of the above description. The driver is operated in the usual way by grasping the handle 18 and squeezing the actuating handle 19 toward it. This lifts the hammer 25 by means of the lifter 29 against the pressure of the spring 36. At the top of the stroke the lifter 29 is moved out of the slot in the hammer and the hammer falls downwardly, carrying the staple driver blade 26 with it. This blade usually strikes the foremost of the staple 39 and drives it outwardly through the opening 38. In the present case, however, when the blade 26 moves downwardly, the abutment 44 maintains the staples away from the path of the stroke of the blade; this means that the blade moves downwardly in the usual way, but that there is no staple for it to strike. The movement of the blade is not prevented by the abutment 44, because the abutment slides in the slot 43 in the blade 26. When the base 16 is pressed against a working surface, however, the working surface strikes the end of the finger 41 and moves the entire plate 45 upwardly. The rivet 46 engages the upper leg of the Y-shaped slot 47 and guides the plate upwardly. The finger operating in the slot 49 also serves to guide the entire arrangement for vertical movement. The upward movement is resisted by the spring 42 whose legs slide along the inclined surfaces of the point 48. As soon as the plate 45 is moved vertically upwardly (the end of the finger 41 being raised as high as the bottom surface of the base 16), the abutment 44 is moved away from the foremost staple, so it can be pushed by the spring 52 and the slide 32 against the inner surface of the frame 13 and into the path of the staple blade 26. Then, when the blade comes down, it strikes the leading staple and drives it through the opening 38.

It can be seen that the present invention causes the driving of a staple to be inhibited unless the bottom surface of the base 16 is pressed against the working surface. In other words, it is possible to drive a staple into the air. A child playing with the stapling gun will not be able to "shoot" staples and injure himself or his playmates. Furthermore, a workman cannot accidentally fire the staple and do similar damage. The construction is relatively simple and inexpensive to apply to existing driver designs and can be used either on stapling guns or on nail drivers of the conventional type.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A driver for a series of fasteners, comprising a. a housing having a handle and a fastener exit, b. a guide mounted in the housing presenting the fasteners seriatim to the said fastener exit, c. means mounted in the housing for driving a fastener through the exit, the said means including a spring-loaded hammer with a driver blade slidable toward and away from the exit and a lever provided to lift the hammer and then release it for the driving operation, the driver blade being provided with a median slot, and d. a safety device mounted on the housing and normally inhibiting the driving of a fastener but allowing it when the exit is pressed against a surface, the safety device including a finger extending away from the housing adjacent the exit and movable by movement of the housing toward and away from the surface, the finger being biased by a spring into a normally-extended position where it inhibits the driving of a fastener, but can be moved into a retracted position by contact with the surface, in which position it allows the driving of the fastener, the safety device having an abutment that extends through the driver blade slot for engagement in the inhibiting position with the leading end of the series of fasteners, the slot being of sufficient size that the abutment does not interfere with the movement of the hammer and the driving blade.

2. A driver as recited in claim 1, wherein the housing is provided with an end wall extending perpendicular to a flat bottom wall in which the exit is formed, wherein the safety device is provided with a flat plate which is slidable on the surface of the end wall and carries the finger at its lower end adjacent the bottom wall, and wherein a rivet is fixed in the end wall and extends through a slot in the plate.

3. A driver as recited in claim 2, wherein the slot is of reversed Y-shape defining an upwardly directed point, and wherein the aforementioned spring is U-shaped and is mounted on the rivet with its legs straddling and engaging the sides of the point.

4. A driver as recited in claim 3, wherein the end wall is provided with a slot adjacent the bottom wall, the finger being bent away from the plane of the plate so as to reside in and be guided by the slot.

* * * * *